US006099418A

United States Patent [19]

Owen

[11] Patent Number: 6,099,418

[45] Date of Patent: Aug. 8, 2000

[54] BATTING TEE FOR MAXIMIZING BAT TO BALL CONTACT

[76] Inventor: James Owen, 64 Colgate Ave., Paramus, N.J. 07652

[21] Appl. No.: 08/941,929

[22] Filed: Oct. 1, 1997

[51] Int. Cl.[7] ..... A63B 69/00

[52] U.S. Cl. ..... 473/417

[58] Field of Search ..... 473/417

[56] References Cited

U.S. PATENT DOCUMENTS

| | | | |
|---|---|---|---|
| 2,616,692 | 11/1952 | Bird | 473/417 |
| 2,652,250 | 9/1953 | Alder et al. . | |
| 2,976,041 | 3/1961 | White . | |
| 3,139,282 | 6/1964 | Lande | 473/417 |
| 3,489,411 | 1/1970 | Morrelli | 473/417 |
| 4,227,691 | 10/1980 | Lefebvre | 473/417 |
| 4,383,686 | 5/1983 | Cardieri | 473/417 |
| 4,445,685 | 5/1984 | Cardieri . | |
| 4,456,250 | 6/1984 | Perrone | 473/417 |
| 4,575,080 | 3/1986 | Miles . | |
| 4,664,374 | 5/1987 | Groves | 473/417 |
| 4,709,924 | 12/1987 | Wilson et al. . | |
| 4,796,885 | 1/1989 | Wright | 473/417 |
| 4,819,937 | 4/1989 | Gordon | 473/417 |
| 4,886,267 | 12/1989 | Licciardi et al. . | |
| 4,962,924 | 10/1990 | James | 473/417 |
| 4,989,866 | 2/1991 | Dill | 473/417 |
| 5,004,234 | 4/1991 | Hollis | 473/417 |
| 5,076,580 | 12/1991 | Lang . | |
| 5,388,823 | 2/1995 | Prieto | 473/417 |
| 5,556,091 | 9/1996 | Lin | 473/417 |
| 5,580,047 | 12/1996 | Shih | 473/417 |
| 5,662,563 | 9/1997 | Martinez | 473/417 |

*Primary Examiner*—Steven Wong
*Attorney, Agent, or Firm*—Arthur L. Plevy

[57] ABSTRACT

A batting tee device for training a batter to contact a pitched baseball only along an optimal line of contact, the batting tee including a tee member for holding a ball to batted above a ground surface and a base member for supporting the tee member in a generally vertical position relative to the ground surface. The tee member includes a ball support member disposed at a free end thereof and the base member includes a portion representing a baseball home-plate. The batting tee is adapted to allow at least the ball support member of the tee member to be selectively located only along a single predetermined optimal line of contact located relative to the portion of the base member representing the baseball home-plate for left-handed or right-handed batters.

17 Claims, 9 Drawing Sheets

BATTING TEE FOR MAXIMIZING BAT TO BALL CONTACT

FIELD OF THE INVENTION

The present invention relates to baseball training devices and more particularly to an adjustable batting tee that selectively locates a ball relative to a home-plate shaped portion of the base to train the user to maximize bat to ball contact.

BACKGROUND OF THE INVENTION

Batting tees are well known in the art for use in instructing and improving a baseball player's batting ability. Most existing batting tees have a base member constructed in the shape of a home-plate, with a ball supporting post or "tee" extending up from the base member upon which a baseball or the like to be batted is supported. The tee usually has some type of telescopic construction which enables the height of the ball to be adjusted to simulate high and low pitches, as well as to compensate for different sized players or batters.

Many existing batting tee designs attach the tee in the center of the base member thereby permitting a batter to contact the ball in a limited number of positions which vary only in height. Other batting tee designs have variably adjustable tee members which permit a batter to contact the ball at various points relative to the base, with some batting tee designs even allowing contact at virtually any point relative to the base.

With this in mind, it has long been established that the best place to hit a baseball is on the "sweet spot" of the baseball bat. Although the bat itself usually ranges from 28 to 34 inches in length, the "sweet spot" 12 of a baseball bat 10 covers only about six inches as shown in FIG. 1A. The goal then, for a batter, is to swing the bat 10 such that the sweet spot 12 of the bat 10 contacts an incoming pitched ball 14. The problem, however, is that there is a precise, optimal location relative to home-plate 16 for contacting the pitched ball 14 with the sweet spot 12 of the bat 10, this precise, optimal location being dependent upon where the pitched ball 14 is located relative to home-plate 16.

The assumption that a batter should hit the ball when it's "over-the-plate" has been found in many instances to be untrue, especially if the ball is pitched toward the inside corner of home plate (the side of the home plate closest to the batter). In FIG. 1A, which depicts the case of a right-handed batter, if the batter waits to hit the inside-pitched ball 14 until after it crosses over the plate 16, the batter will contact the ball 14 very weakly on the narrow part 18 of the bat 10. Accordingly, as shown in FIG. 1B, the only way to hit the inside-pitched ball 14 with the sweet spot 12 of the bat 10 is to make contact with the ball 14 before it crosses over home-plate 16. The result of this ideal contact, is that the inside-pitched ball is hit solidly and is "pulled" down the left-field line.

In the case of a ball 14 pitched toward a right-handed batter in the middle of home-plate 16 as shown in FIG. 2A, although baseball experts will correctly argue that this pitch can be hit to all fields, if the batter waits to hit the ball 14 until after it crosses over the plate 16, the batter will again contact the ball 14 weakly on the narrow part 18 of the bat 10. Consequently, the best place to make contact with the ball 14 is just out in front of the home plate 16 as depicted in FIG. 2B. This is because the batter has more power as the batter's arms can be extended to hit the ball 14 directly on the sweet spot 12 of the bat 10. Notice that the angle of the batted ball 14' goes toward left-center field, which has long been called the "power alley" for right-handed batters.

Only in the case of a ball pitched toward a right-handed batter at the outside corner of home-plate (the corner of the plate farthest from the batter), is the assumption that a batter should hit the ball when it's "over-the-plate" more or less true. Many baseball coaches tell their players to "wait on" outside pitches or "go the other way," i.e. hit the outside pitch to right field (in the case of right-handed batters). The reason for this advise relates to hitting the ball with the sweet spot of the bat. As depicted in FIG. 3A, if a batter swings too soon at the outside-pitched ball 14, for example, as the ball 14 just crosses the leading edge the plate 16, the batter will contact the ball 14 with the end 19 of the bat 10, and hit a weak grounder or pop-up to the shortstop. If, however, the batter hits the ball 14 just as it crosses the back outside corner of home plate 16 as shown in FIG. 3B, the batter will contact the ball 14 with the sweet spot 12 of the bat 10 and drive it to right-center field.

Thus, a batter can optimize his or her batting skills by contacting the ball at a precise, optimal location which varies according to the location of the pitched ball, so that the sweet spot of the bat is always used to hit the ball. This being the case, it would be desirable to train batters to swing and hit pitched balls only along this line. However, prior art batting tees are not capable of such training since, they either position the ball only over the center of the base or allow unlimited ball placement anywhere in front of and/or over the plate. None of the prior art batting tee are known to only place the ball along an optimal line of contact.

Accordingly, there is a need for batting tee that trains a batter to contact a pitched baseball only along an optimal line of contact.

SUMMARY

A batting tee device for training a batter to contact a pitched baseball only along an optimal line of contact, the batting tee comprising tee means for holding a ball to batted above a ground surface and base means for supporting the tee means in a generally vertical position relative to the ground surface. The tee means includes ball seating means disposed at a free end thereof and the base means includes a portion representing a baseball home-plate. Locating means associated with one of the tee means and the base means, are provided for allowing at least the ball seating means of the tee means to be selectively located only along a single predetermined optimal line of contact located relative to the portion of the base means representing the baseball home-plate.

In one embodiment, the locating means includes continuous adjusting means for allowing at least the ball seating means of the tee means to be selectively located only along the predetermined optimal line of contact at a substantially infinite number of locations.

In another embodiment, the single predetermined optimal line of contact comprises a single predetermined optimal line of contact for left-handed batters and a single predetermined optimal line of contact for right-handed batters, the locating means allowing selective location only along either one of the single predetermined optimal lines of contact for left-handed and right-handed batters.

BRIEF DESCRIPTION OF THE DRAWINGS

For the purpose of illustrating the present invention, reference should be made to the FIGS. 1A and lB respectively illustrate the improper and proper location to engage an inside-pitched baseball with a baseball bat.

DETAILED DESCRIPTION OF THE INVENTION

As will become apparent further on, the batting tee of the present invention is constructed keeping in mind what is known about hitting a ball with the sweet spot of a bat, as described above. It has been found that in order for a right-handed batter to hit a pitched baseball with the sweet spot of a baseball bat, the relationship between the precise, optimal location of ball contact and the location of the pitched ball is generally along the line denoted by numeral 20 in FIG. 4 called the "optimal line of contact." For a left-handed batter, this optimal line of contact is denoted by numeral 22. Both optimal lines of contact 20, 22 are disposed at an angle θ measured from the leading edge of home plate, the angle θ approximately ranging between 45 and 65 degrees. The batting tee of the present invention is constructed to train batters to contact a pitched baseball only along these optimal lines of contact so that only the sweet spot of the bat contacts the ball for maximum hitting efficiency.

Figure 5:
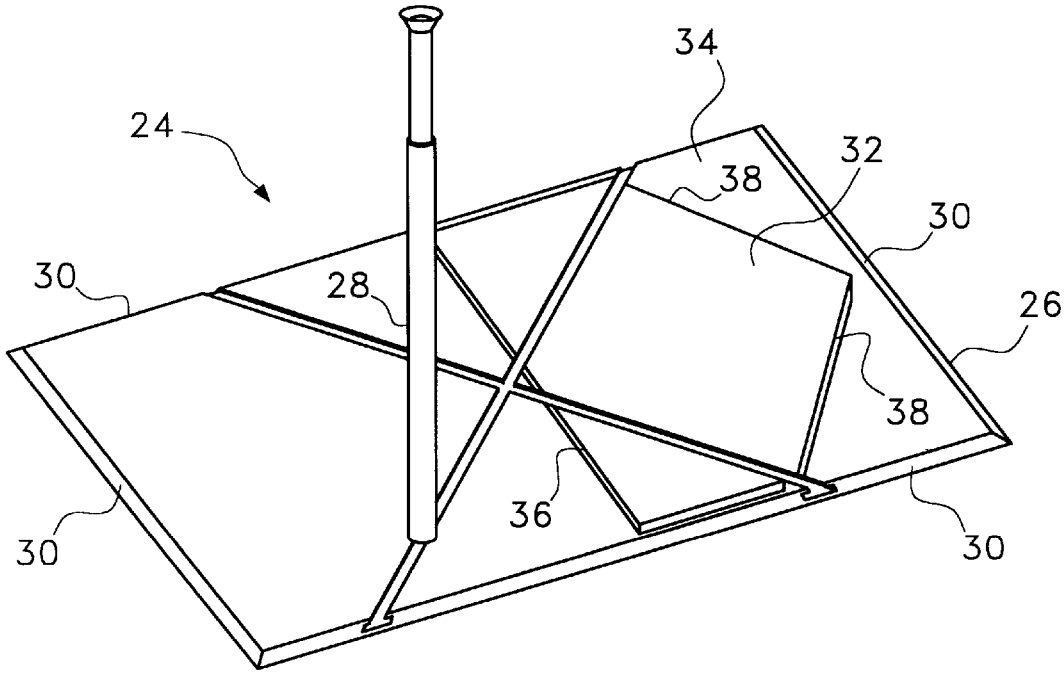
FIG. 5 is a perspective view of a batting tee constructed according to a first embodiment of the present invention.
Figure 6:
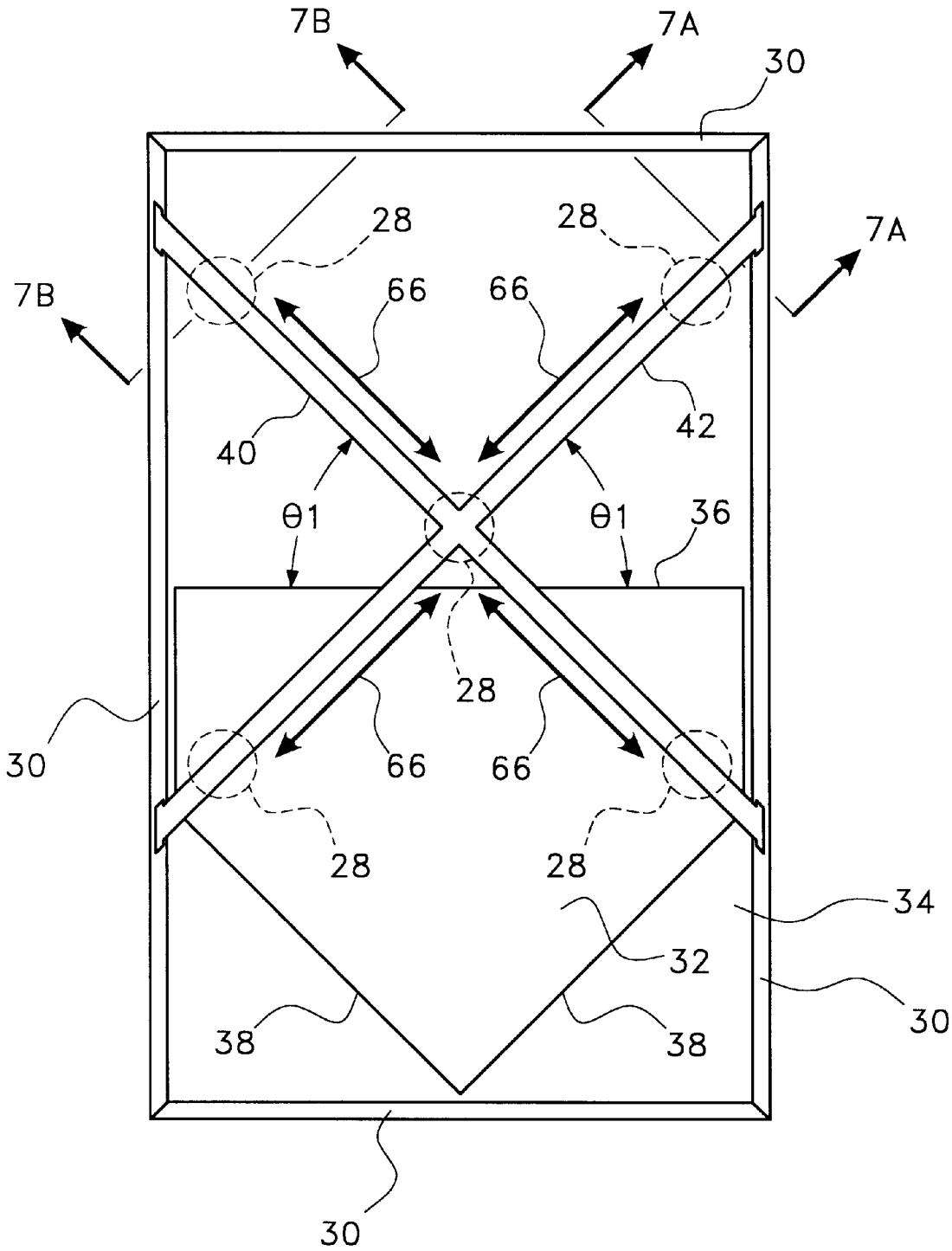
FIG. 6 is top plan view of the batting tee of FIG. 5.

Referring now to both FIGS. 5 and 6, a batting tee 24 constructed in accordance with an exemplary embodiment of the present invention is shown. The batting tee 24 generally comprises a planar base member 26 and a telescopically adjustable tee member 28 that is slidably attached to the base member 26 as will be explained further on. The overall dimensions of the batting tee 24 can be sized for adults and children of varying age.

The planar base member 26 is generally rectangular in shape although other shapes are possible, and preferably manufactured from any suitably rigid material such as plastic. The base member 26 is preferably constructed with beveled upper edge surfaces 30 and a portion 32 which is raised up approximately ⅛ of an inch from an upper surface 34 of the base member 26. The raised portion 32 is generally shaped like a baseball "home-plate," and includes a leading edge 36 and a V-shaped trailing edge 38. The beveled edge surfaces 30 of the base member 26 help prevent users from tripping when walking or running across the batting tee 24, and the home-plate shaped raised portion 32 operates as guide for enabling a batter to correctly position their body relative to the batting tee 24.

Figure 1A:
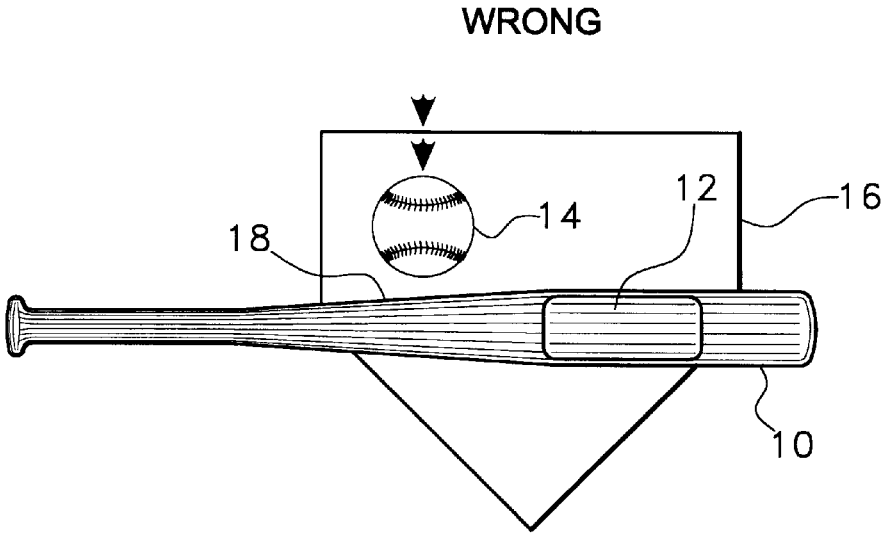
Figure 1B:
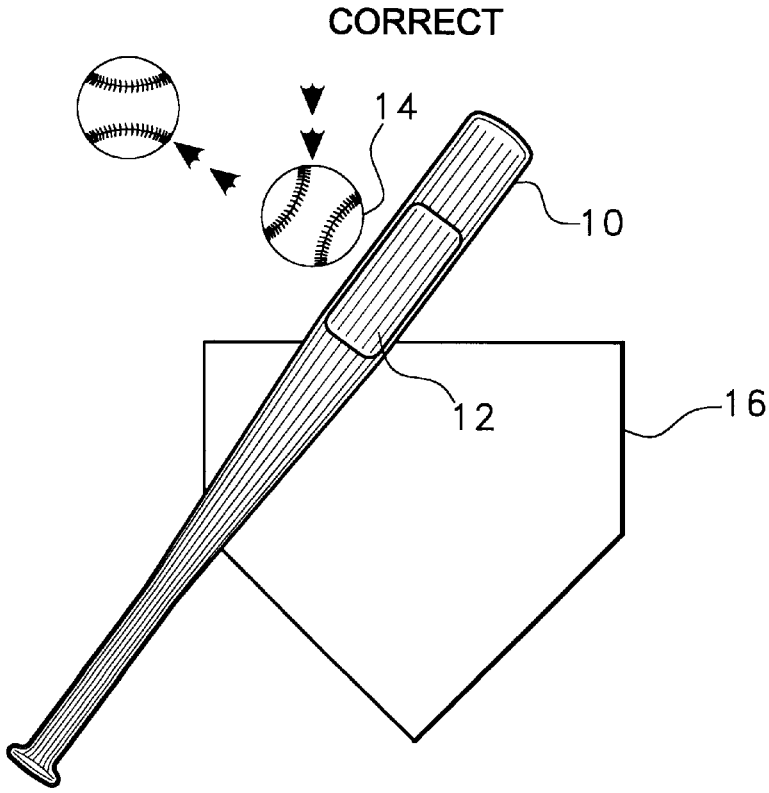
Figure 2A:
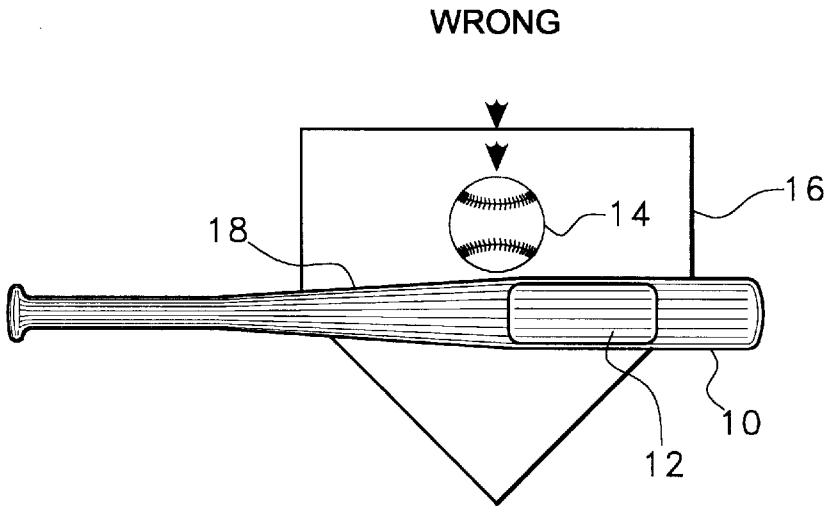
FIGS. 2A and 2B respectively illustrate the improper and proper location to engage a down-the-middle pitched baseball with a baseball bat.
Figure 2B:
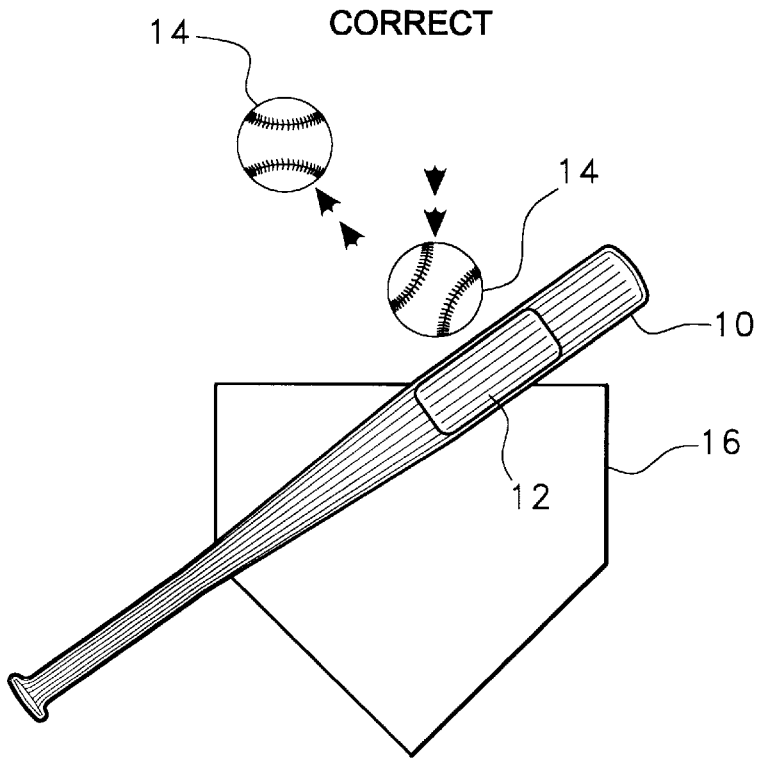
Figure 3A:
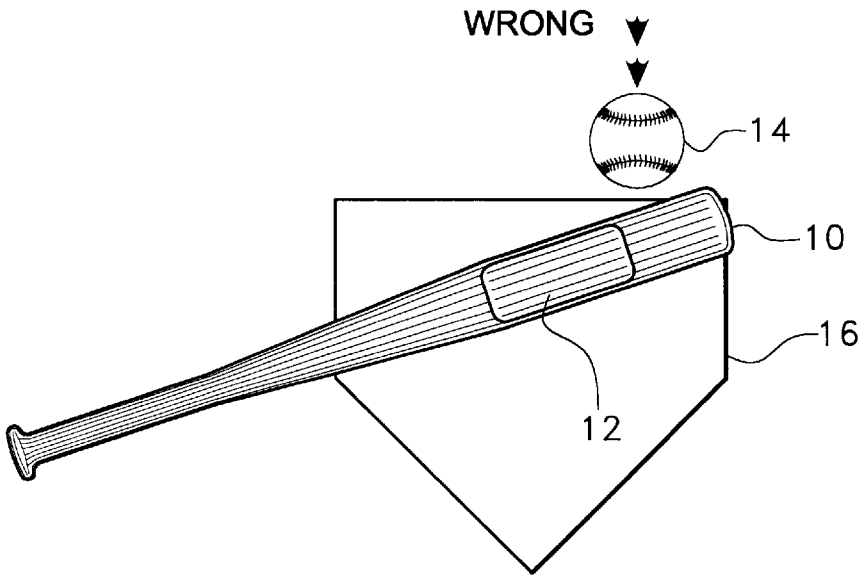
FIGS. 3A and 3B respectively illustrate the improper and proper location to engage an outside-pitched baseball with a baseball bat.
Figure 3B:
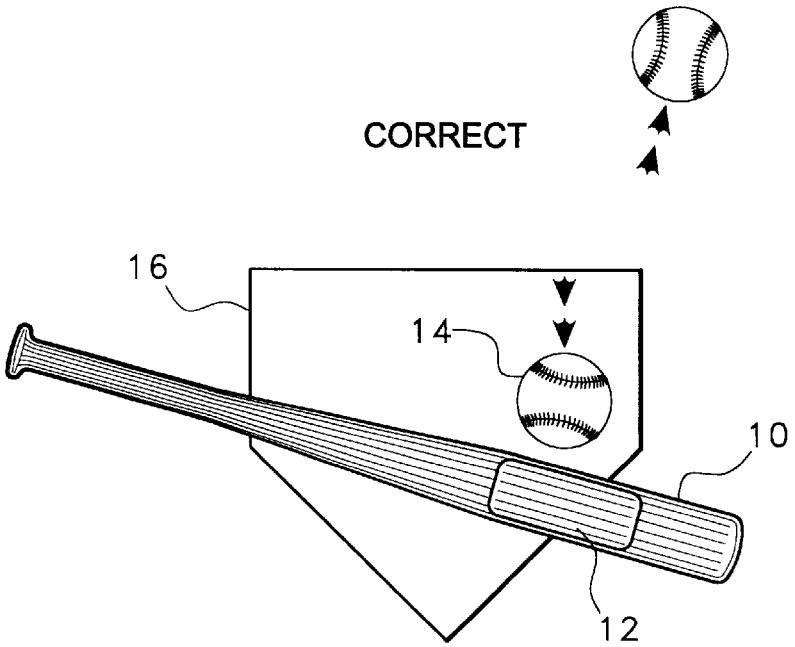
Figure 4:
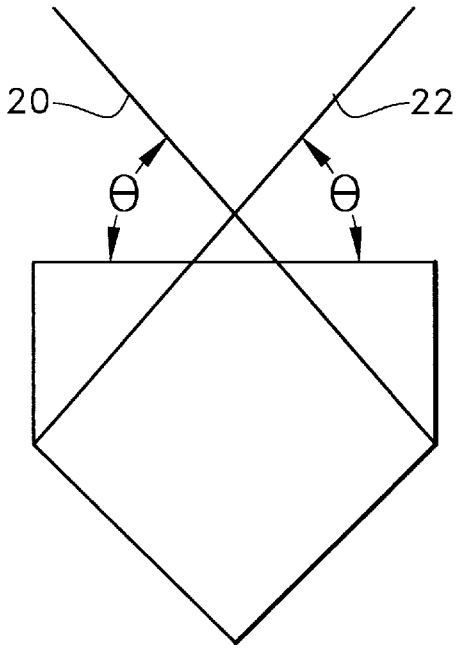
FIG. 4 depicts the relationship between the precise, optimal location of ball contact and the location of the pitched ball.

The upper surface 34 of the planar base member 26 also includes a pair of groove-like tracks 40, 42. The first groove-like track 42 allows the tee member's location to be infinitely adjusted along the optimal line of contact 20 for right-handed batters (FIG. 4) and the second groove-like track 42 allows the tee member's location to be infinitely adjusted along the optimal line of contact 22 for left-handed batters (FIG. 4). Accordingly, each groove-like track 40, 42 extends diagonally across the upper surface 34 of the base member 26 along its corresponding optimal line of contact at an angle $\theta_1$ measured from the leading edge 36 of the raised portion 32, the angle $\theta_1$ approximately ranging between 45 and 65 degrees, depending upon the overall dimensions of the batting tee device 24. Further, the first and second groove-like tracks 40, 42 intersect each other just before the leading edge 36 of the raised portion 32, the exact location of intersection also being dependent upon the overall dimensions of the batting tee 24.

Figure 7A:
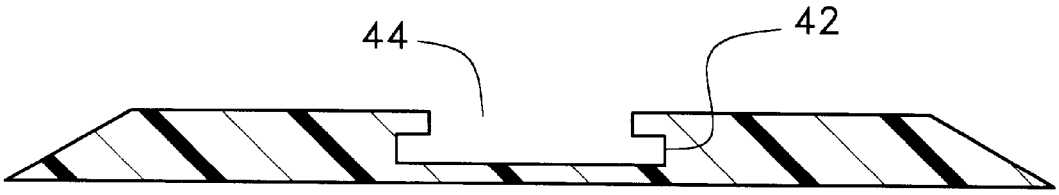
FIG. 7A is a cross-sectional view through line 7A—7A of FIG. 6 which shows the structural details of one of the groove like tracks defmed in the base member.

The structure of one of identically configured groove-like tracks 40, 42 is best shown in FIG. 7A, which is a cross-sectional view through line 7A—7A of FIG. 6. The groove-like track 42 has an upside down T-shaped cross-sectional profile define by opening 44 which is narrower than the bottom of the track. As shown in FIGS. 4 and 5, the ends of the groove-like tracks 40, 42 open into the beveled edge surfaces 30 in order to allow the tee member 28 to be easily placed therein as will be explained further on.

Figure 7B:
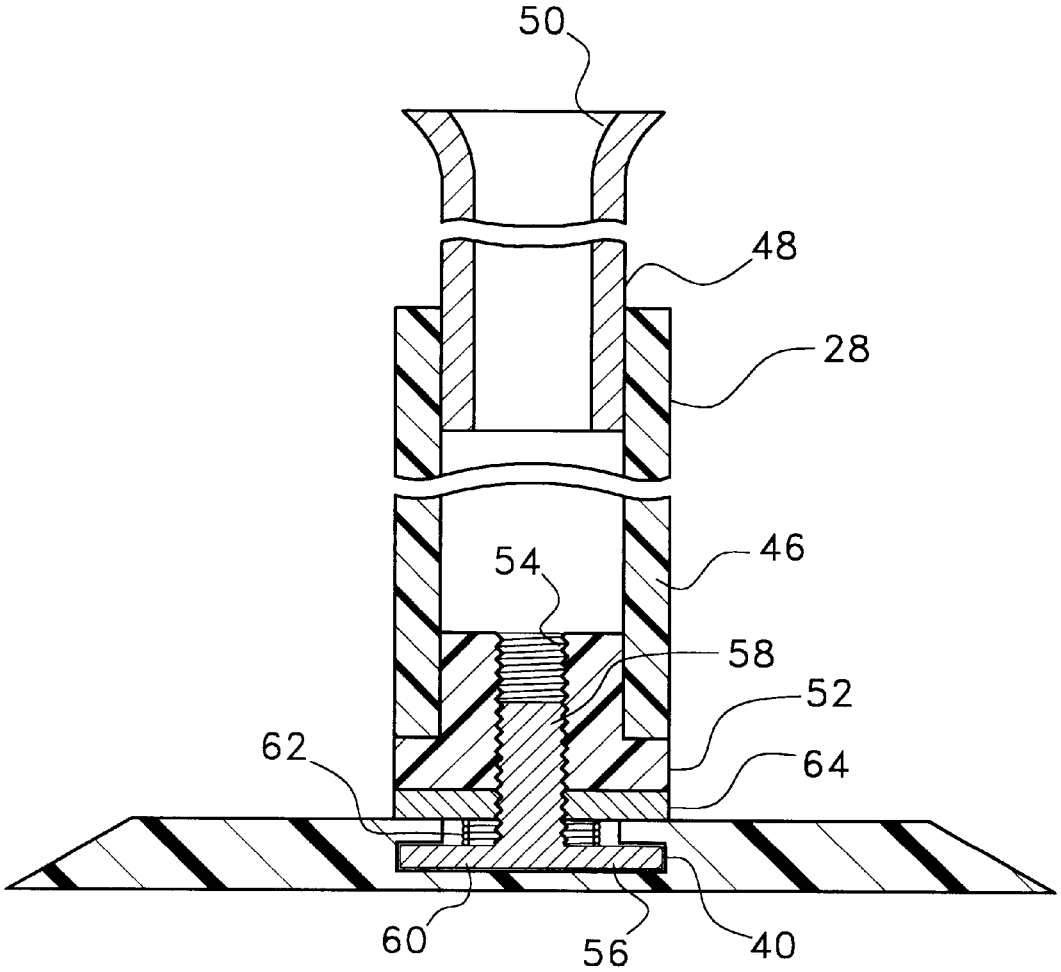
FIG. 7B is a cross-sectional view through line 7B—7B of FIG. 6 which shows the structural details of the tee member.

Referring to FIG. 7B, the telescopically adjustable tee member 28 comprises a hollow cylindrical lower post 46 and a hollow cylindrical upper post 48. The upper post 48 is telescopically received within the upper end of the lower post 46 for sliding movement therebetween so that the height of the ball can be adjusted and maintained. The free end of the upper post flares outwardly to form a conical-shaped member 50 for holding a baseball or softball sized ball. At least the upper post 48 of the tee member 28 is made of a resilient material like rubber so as to partially absorb the shock when it is hit by the batter. Preferably the lower post 46 of the tee member 28 is made of substantially rigid yet resilient material such a plastic. In some embodiments of the invention, the low post may include a cylindrical metal liner (not shown) inserted therein for additional strength.

A flanged plug 52 having a threaded aperture 54 is inserted in the bottom end of the lower post 46. A track follower 56 is threaded in the aperture 54 of the plug 52. The track follower 56 has a threaded shank 58 and a square or rectangular-shaped head 60. The threaded shank 58 of the follower 56 extends through a coil spring 62 and a washer 64. The coil spring 62 biases the washer 64 against the plug 52 to facilitate installation of the tee member 28 in the groove-like tracks 40, 42. The track follower 56 allows the tee member 28 to be slidably coupled in either one of the groove-like tracks with the head 60 slidably inserted in the wider bottom portion of the track 40 and the threaded shank 58 extending through the narrower opening portion of the track.

Figure 7C:
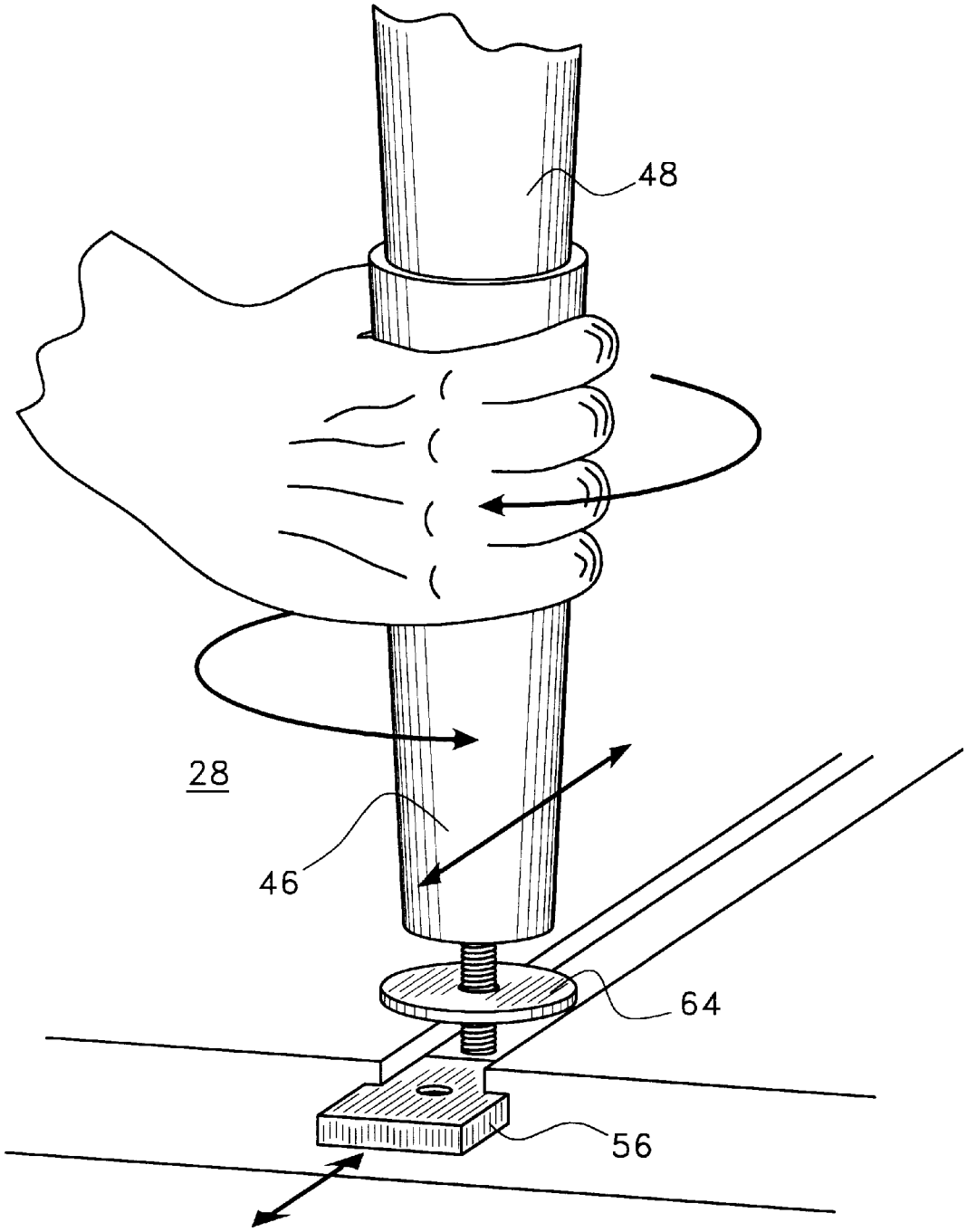
FIG. 7C is a perspective view that illustrates how the tee member is attached to the base member.

As depicted in FIG. 7C, the tee member 28 is attached to the base member 26 by twisting the lower post counterclockwise relative to the follower 56 to increase the distance between it and the lower post 46 so that the head 60 of the follower 56 can be slidably inserted into either end of the groove-like track. The tee member 28 is then slidably moved across the base member 26 in the directions of the arrows 66 to any location along the track depending upon what type of pitch is to be simulated as shown in FIG. 6. Once positioned, the lower post 46 is twisted clockwise to decrease the distance between it and the follower 56 such that the washer 64 is compressed between the upper surface 34 of the base member 26 and the plug 52, thereby locking the position of tee member 28.

The batting tee of the present invention allows the batter to contact the ball only along the optimal line of contact as defined by the groove-like tracks. Accordingly, the batter has no choice other than to hit the ball with the sweet spot of the bat. The tee of the present invention is based on the belief on the belief that there are more wrong locations relative to home-plate to hit a baseball than correct locations relative to home-plate to hit a baseball. As discussed earlier, other batting tee designs permit a batter to contact the ball at various locations relative to the base member. Some batting tee designs even allow contact at virtually any location relative to the base member. The tee of the present invention is unique in that it does not encourage random contact of the ball. Rather, it trains a batter to hit the ball solidly on the "sweet spot" of the bat with virtually every swing thereof.

Figure 8A:
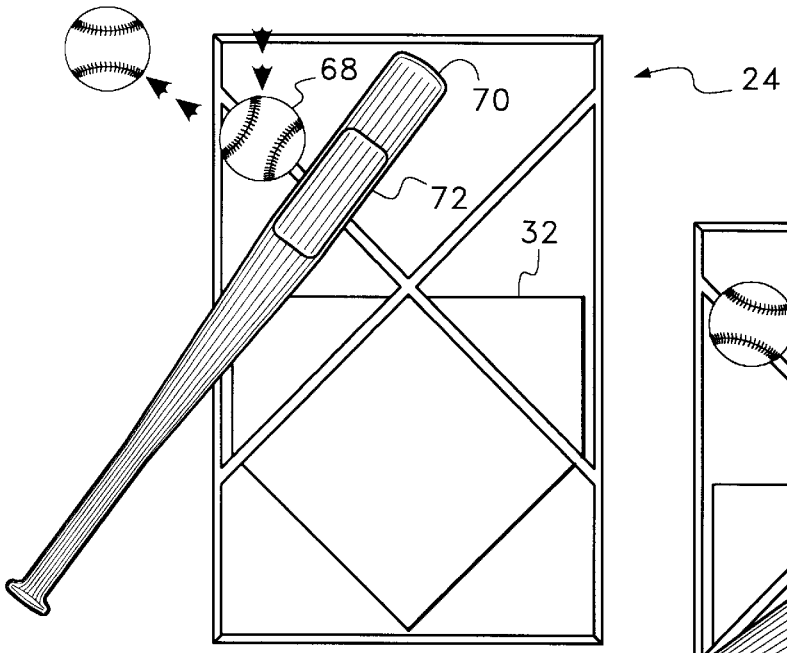
FIGS. 8A–8C depict the operation of the batting tee of the present invention.
Figure 8B:
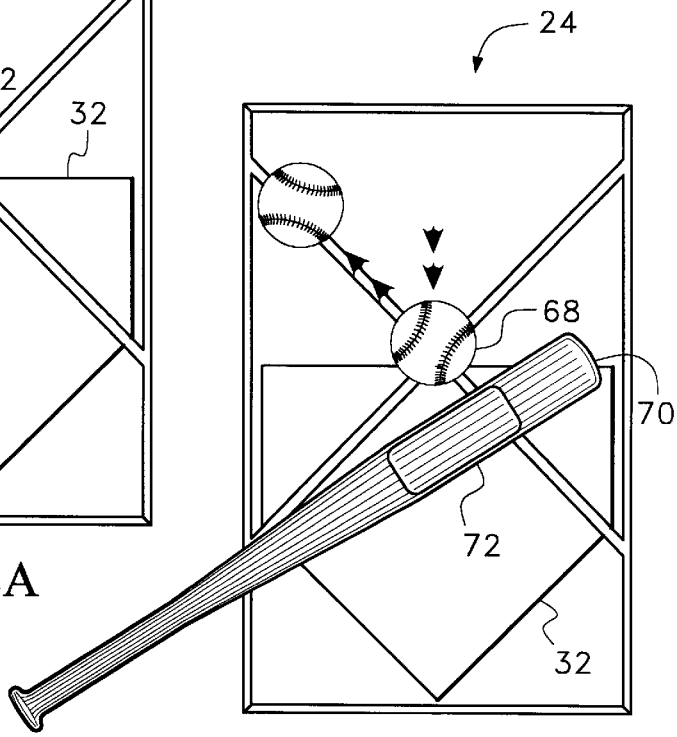
Figure 8C:
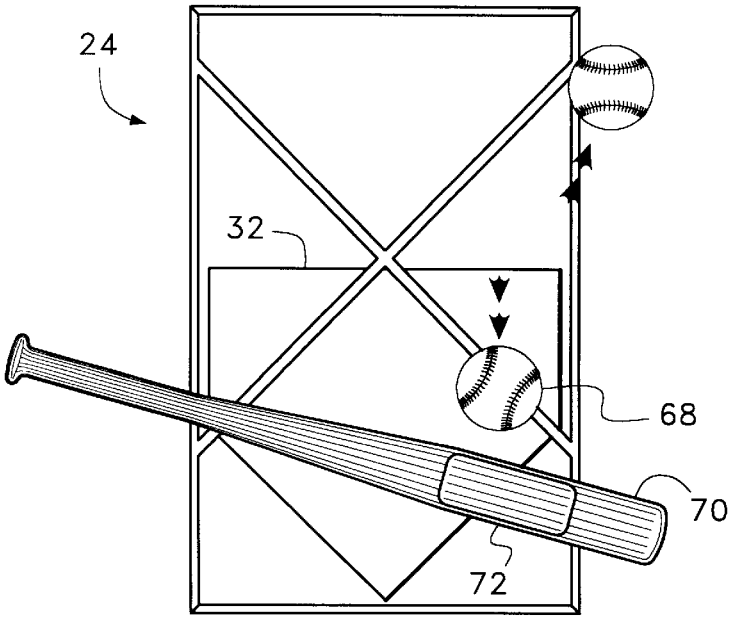

The operation of the batting tee 24 of the present invention is illustrated in FIGS. 8A–8C. In particular, FIGS. 8A–8C depict a right-handed batter training to hit a ball 68 located near the inside corner of the raised portion 32 (FIG. 8A), near the middle of the raised portion 32 (FIG. 8B), and over the outside corner of the raised portion (FIG. 8C) using the batting tee 24 of the present invention. As shown, the batting tee 24 only allows contact with the ball 68 on the sweet spot 72 of the bat 70, thus, resulting in ideal contact with the ball 68.

Figure 9A:
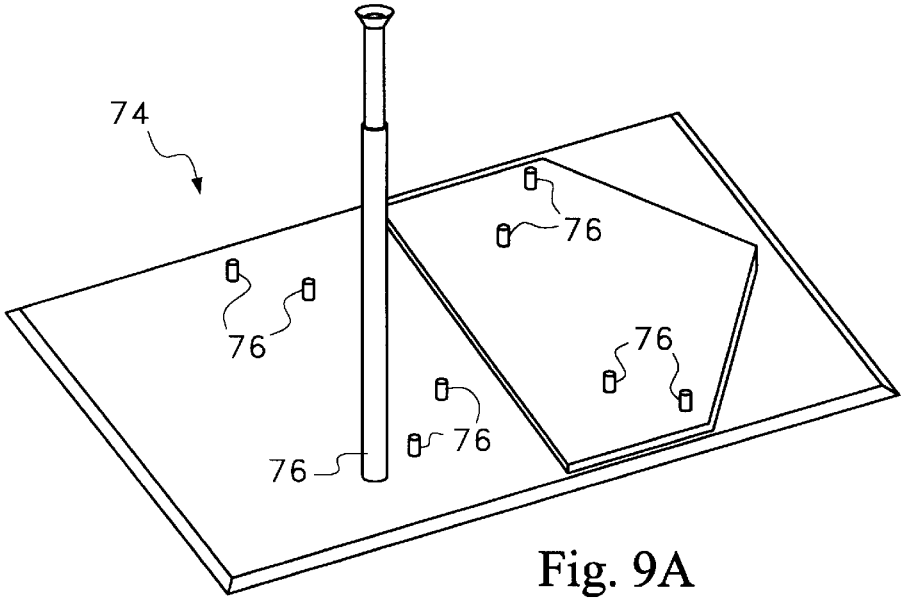
FIG. 9A is a perspective view of a batting tee constructed according to a second embodiment of the present invention.

Referring now to FIG. 9A, a batting tee 74 according to a second embodiment of the invention is shown. In the second embodiment, the groove-like tracks in the base member of the first embodiment are replaced by a plurality of pegs 76 disposed along the optimal lines contact, and the follower in the end of the lower post of the tee member is omitted and the aperture sized to receive any one of the pegs in a friction-fit manner.

Figure 9B:
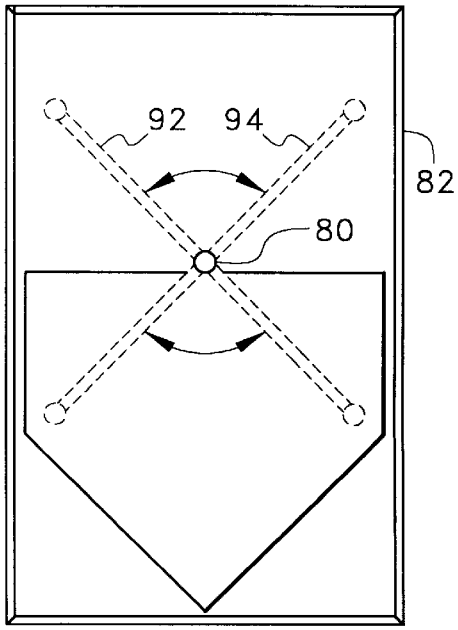
FIG. 9B is a top plan view of a batting tee constructed according to a third embodiment of the present invention.

Referring to FIG. 9B, a batting tee 78 according to a third embodiment of the invention is shown. In the third embodiment, the tee member 80 is rotatively mounted to the base member 81 at a location on the upper surface of the base member where the groove-like tracks of the first embodiment would normally intersect.

Figure 9C:
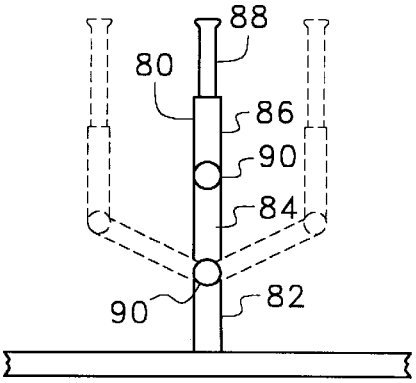
FIG. 9C is a partial side elevational view of the batting tee of FIG. 9C.

As shown in FIG. 9C, the tee member 80 of the third embodiment includes three pivotally connected hollow cylindrical members 82, 84, 86 which define a lower post and a hollow cylindrical upper post 88 that is telescopically received in the upper-most lower post member 86. The three lower post members 82, 84, 86 are pivotally connected to each other by two conventional screw-lockable hinges 90. The hinges 90 allow the three lower post members 82, 84, 86 to be locked in a vertical position where all three lower post members are arranged in straight line. The screw-lockable hinges 90 allow articulated movement of the upper-most lower post member 86 relative the lowermost post member 82 which enables the tee member 80 to be continuously adjusted along the selected optimal line of contact. Since the lowermost post member 82 is rotatably attached to the base member 81, the entire tee member 80 can be rotated relative to the base member 81 between two positions, the first position being for right-handed batters (broken lines 92) and the second position (broken lines 94) being for left handed batters.

As in the previous two embodiments, at least the upper post 88 of the tee member 80 is made of a resilient material like rubber so as to partially absorb the shock when hit by the batter. Preferably the three members 82, 84, 86 of the lower post are made of substantially rigid yet resilient material such a plastic.

It will be understood that the embodiments described herein are merely exemplary and that a person skilled in the art may make many variations and modifications to the described embodiments utilizing functionally equivalent elements to those described. Any variations or modifications to the invention described hereinabove are intended to be included within the scope of the invention as defined by the appended claims.

What is claimed is:

1. A batting tee device comprising:

tee means for holding a ball to be batted above a ground surface, said tee means including ball seating means disposed at a free end thereof;

base means for supporting said tee means in a generally vertical position relative to the ground surface, said base means including a portion representing a baseball home-plate having a leading edge, a V-shaped trailing edge, and parallel side edges extending between said leading and trailing edges; and locating means for allowing at least said ball seating means of said tee means to be selectively located only along one of two predetermined optimal straight lines of contact, each of said lines being disposed at an angle measured from a point on said V-shaped trailing edge located nearest said leading edge, each of said lines of contact starting at a location adjacent to where one of said side edges and said V-shaped trailing edge merge and extending beyond said leading edge in a direction opposite said V-shaped trailing edge.

2. The batting tee device according to claim 1, wherein said locating means includes continuous adjusting means for allowing at least said ball seating means of said tee means to be selectively located only along said predetermined optimal lines of contact at a substantially infinite number of locations.

3. The batting tee device according to claim 1, wherein said locating means is associated with said base member.

4. The batting tee device according to claim 1, wherein said locating means is associated with said tee member.

5. The batting tee device according to claim 1, wherein said predetermined optimal lines of contact comprise a predetermined optimal line of contact for left-handed batters and a predetermined optimal line of contact for right-handed batters, said locating means allowing selective location only along either one of said single predetermined optimal lines of contact for left-handed and right-handed batters.

6. The batting tee device according to claim 1, wherein said angle ranges between approximately 45 and 65 degrees.

7. A batting tee device comprising:

a telescopically adjustable tee member for holding a ball to be batted above a ground surface, said tee member including ball seating means disposed at a free end thereof;

a substantially planar base member for supporting said tee member in a generally vertical position relative to the ground surface, said base member including a raised portion which is shaped like a baseball home-plate having a leading edge, a V-shaped trailing edge, and parallel side edges extending between said leading and trailing edges; and locating means for allowing at least said ball seating means of said tee member to be selectively located only along one of two predetermined optimal straight lines of contact, each of said lines being disposed at an angle measured from a point on said V-shaped trailing edge located nearest said leading edge, each of said lines of contact starting at a location adjacent to where one of said side edges and said V-shaped trailing edge merge and extending beyond said leading edge in a direction opposite said V-shaped trailing edge.

8. The batting tee device according to claim 7, wherein said locating means includes continuous adjusting means for allowing at least said ball seating means of said tee member to be selectively located only along said predetermined optimal lines of contact at a substantially infinite number of locations.

9. The batting tee device according to claim 7, wherein said locating means include two straight groove-like tracks defined in said base member, each of said tracks extending along an associated one of said predetermined optimal lines of contact, each of said groove-like tracks cooperating with groove follower means disposed on an end of said tee member which is opposite to said free end, to thereby allow said tee member to be selectively located only along said predetermined optimal lines of contact at a substantially infinite number of locations.

10. The batting tee device according to claim 9, wherein one of said groove-like tracks and its associated predetermined optimal line of contact is for left-handed batters and the other one of said groove-like tracks its associated predetermined optimal line of contact is for right-handed batters.

11. The batting tee device according to claim 7, wherein said locating means include a plurality of pegs extending up from a surface of said base member only along said predetermined optimal lines of contact, each of said pegs being insertable in an aperture disposed in an end of said tee member which is opposite to said free end, to thereby allow said tee member to be selectively located only along said predetermined optimal lines of contact at a plurality of locations.

12. The batting tee device according to claim 11, wherein said plurality of pegs associated with a first one of said predetermined optimal lines of contact is for left-handed batters and said plurality of pegs associated with a second one of said predetermined optimal lines of contact is for right-handed batters.

13. The batting tee device according to claim 7, wherein said locating means are associated with said tee member and include rotatable connected cylindrical members which form said tee member, one of cylindrical members including said ball seating means and a second one of said cylindrical members being coupled to said base member, said rotatable connection allowing said one cylindrical member including said ball seating means to be selectively located by articulating said one cylindrical member relative to said second one of said cylindrical members only along said predetermined optimal lines of contact at a substantially infinite number of locations.

14. The batting tee device according to claim 13, wherein said second one of said cylindrical members is rotatably coupled to said base member so that it can be rotated between first and second positions, whereby said one cylindrical member can be selectively located by said articulating movement along said predetermined optimal lines of contact, one of said predetermined optimal lines of contact being for left-handed batters in said first position and the other one of said predetermined optimal lines of contact being for right-handed batters in said second position.

15. The batting tee device according to claim 14, wherein said angle ranges between approximately 45 and 65 degrees.

16. A method of training a batter to contact a pitched baseball, said method comprising the steps of:

providing tee means for holding a ball to be batted above a ground surface, said tee means including ball seating means disposed at a free end thereof;

providing base means for supporting said tee means in a generally vertical position relative to the ground surface, said base means including a portion representing a baseball home-plate having a leading edge, a V-shaped trailing edge, and parallel side edges extending between said leading and trailing edges; and selectively locating at least said ball seating means of said tee means only along one of two predetermined straight optimal lines of contact each of said lines being disposed at an angle measured from a point on said V-shaped trailing edge located nearest said leading edge, each of said lines of contact starting at a location adjacent to where one of said side edges and said V-shaped trailing edge merge and extending beyond said leading edge in a direction opposite said V-shaped trailing edge.

17. The method according to claim 16, wherein said angle ranges between approximately 45 and 65 degrees.

* * * * *